US005575555A

United States Patent [19]

Chang

[11] Patent Number: 5,575,555

[45] Date of Patent: Nov. 19, 1996

[54] WARNING AND DEFENDING ASSEMBLY

[76] Inventor: Sreter Chang, No. 451, Ta Tien Road, Homei Chen, Chang Hua Hsien, Taiwan

[21] Appl. No.: 381,322

[22] Filed: Jan. 31, 1995

[51] Int. Cl.[6] ..... F21V 33/00

[52] U.S. Cl. ..... 362/109; 362/202; 362/208; 362/399

[58] Field of Search ..... 362/96, 109, 202, 362/208, 253, 399; 340/321; 273/84 R, 67 B

[56] References Cited

U.S. PATENT DOCUMENTS 3,184,589 5/1965 Gibbens ..... 362/208 X 5,428,514 6/1995 Fink, Jr. ..... 362/253

*Primary Examiner*—Stephen F. Husar

*Attorney, Agent, or Firm*—Beveridge, DeGrandi, Weilacher & Young, L.L.P.

[57] ABSTRACT

A warning and defending device includes a cylindrical body having a housing disposed in the hollow interior of the body. A light generating device is engaged in one end of the housing for generating light so as to provide a warning signal. A gas sprayer may be engaged in the cylindrical body when the housing is disengaged from the cylindrical body so as to form a defending device. A rod and other weight members may be engaged in the cylindrical body when the housing is disengaged from the cylindrical body so as to increase weight of the cylindrical body.

6 Claims, 5 Drawing Sheets

WARNING AND DEFENDING ASSEMBLY

BACKGROUND OF THE INVENTION

1. Field of the Invention

The present invention relates to a warning device, and more particularly to a warning and defending assembly.

2. Description of the Prior Art

More and more people enjoy running or jogging in the morning. It is safe to jog in the park or garden. However, it will be dangerous to jog on the road. It is particularly dangerous during the early morning or in the evening. In addition, the joggers normally carry nothing for guarding or for defending themselves against robberies.

The present invention has arisen to provide a warning and defending assembly for the joggers.

SUMMARY OF THE INVENTION

The primary objective of the present invention is to provide a warning and defending assembly for protecting the joggers from hurting by others.

In accordance with one aspect of the invention, there is provided an assembly for warning and defending purposes comprising a cylindrical body including a hollow interior and including a first end and a second end, a lid engaged on the first end of the cylindrical body and including a screw hole formed therein, a housing engaged in the cylindrical body and including a first end having a bolt extended therefrom for engaging with the screw hole of the lid, and including a second end, a light generating means engaged in the second end of the housing for generating light so as to provide a warning signal, a gas sprayer engaged in the cylindrical body when the housing is disengaged from the cylindrical body, and a rod engaged in the cylindrical body when the housing is disengaged from the cylindrical body so as to increase weight of the cylindrical body.

The rod includes a first end having a bolt extended therefrom for engaging with the screw hole of the lid so as to secure the lid to the cylindrical body, the rod includes a second end having a screw hole formed therein, and includes a weight device having a bolt means threadedly engaged with the screw hole of the rod so as to increase weight of the cylindrical body.

The light generating means includes a circuit board and a light bulb received in the second end of the housing, a switch secured to the circuit board, a cap secured to the second end of the housing, a cover slidably engaged in the cap, means for biasing the cover outward of the cap, means for retaining the cover in the cap and for limiting outward movement of the cover, the cover includes an extension for engaging with the switch so as to actuate the switch when the cover is depressed inward of the cap.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
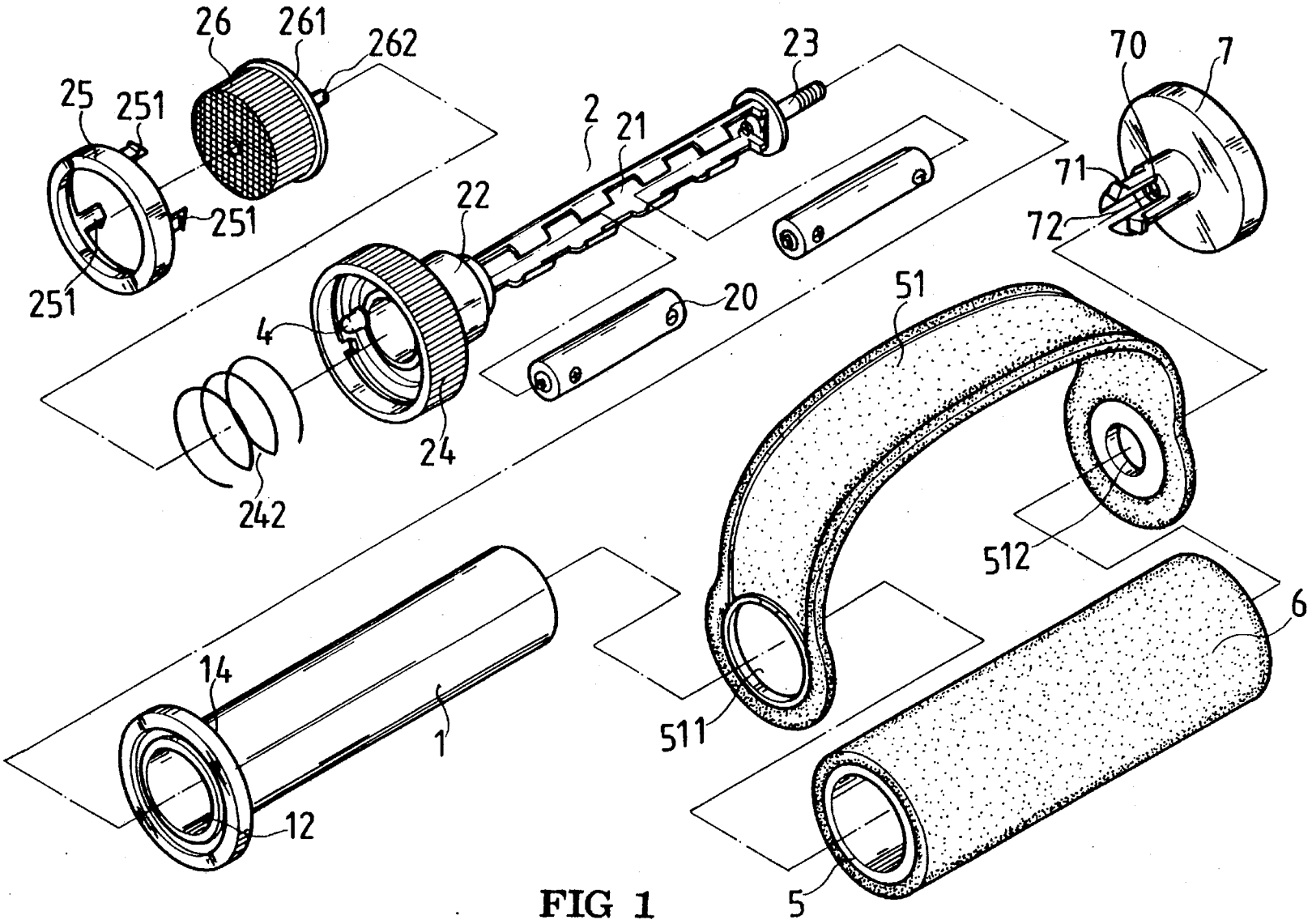
FIG. 1 is an exploded view of a warning and defending assembly in accordance with the present invention.
Figure 2:
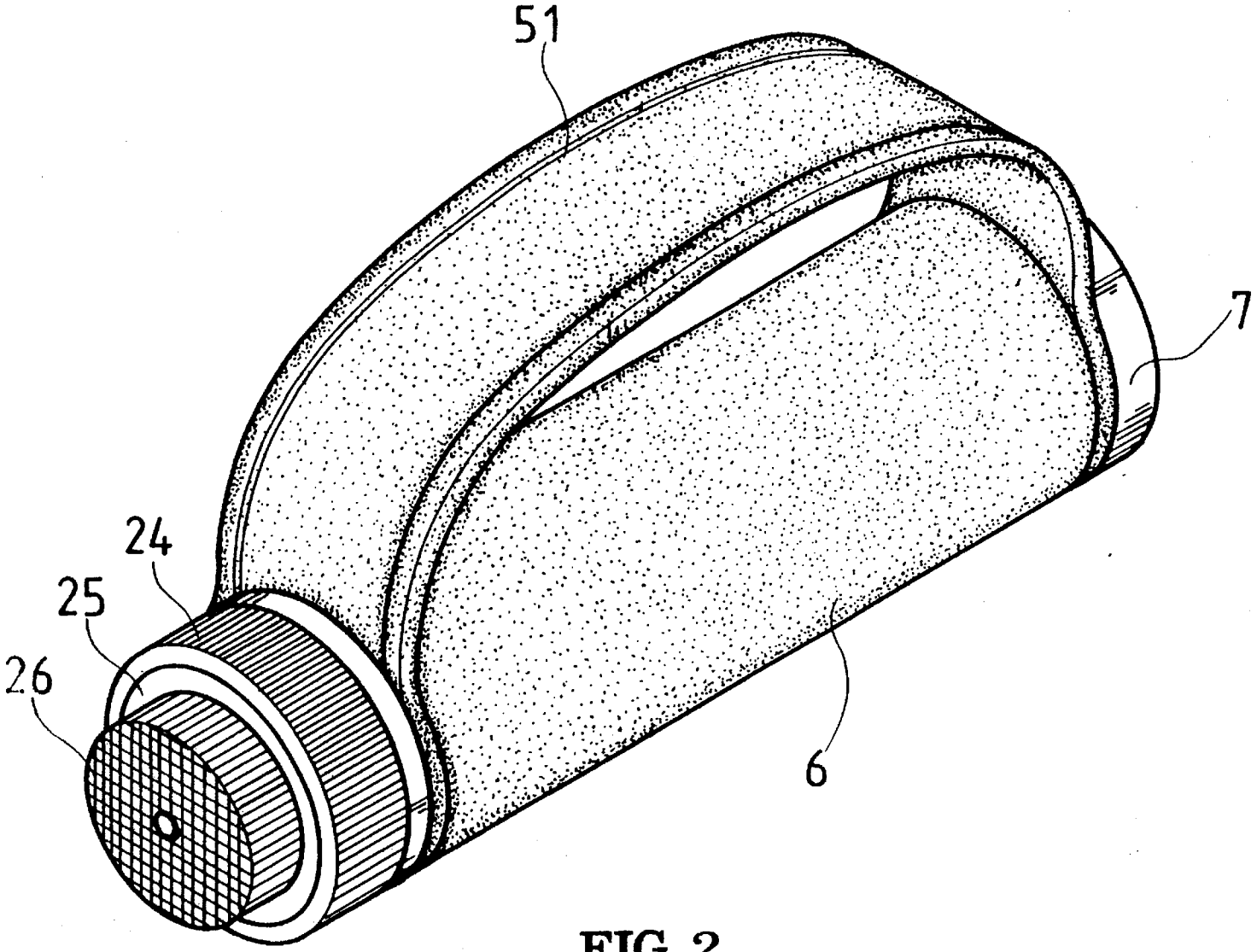
FIG. 2 is a perspective view of the warning and defending assembly.
Figure 3:
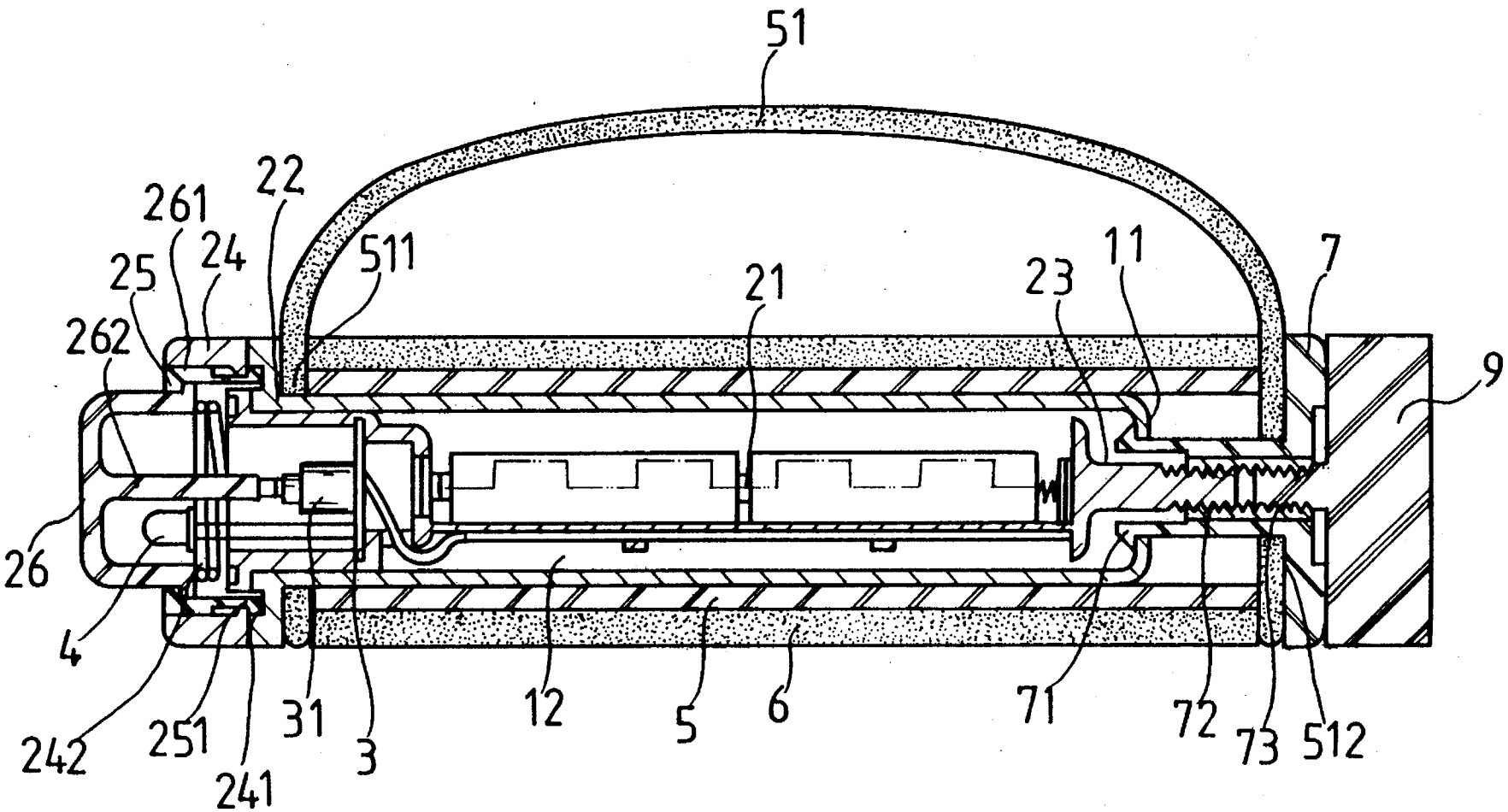
FIG. 3 is a cross sectional view of the warning and defending assembly.

Referring to the drawings, and initially to FIGS. 1 to 3, a warning and defending assembly in accordance with the present invention comprises a cylindrical body 1 including a hollow interior 12 for receiving a warning and signaling device 2, and including an opening 11 formed in one end (FIG. 3). The warning and signaling device 2 includes a housing 21 for receiving batteries 20 therein. The housing 21 includes a casing 22 and a cap 24 formed in one end and includes a bolt 23 extended on the other end thereof. A circuit board 3 and a light bulb 4 are received in the housing 21. A switch 31 is secured on the circuit board 3 (FIG. 3).

A ring element 25 is engaged in the cap 24 and includes three hooks 251 engaged in three holes 241 (FIG. 3) formed in the cap 24 so as to be secured to the cap 24. A cover 26 is partially engaged in the cap 24 and includes an annular flange 261 engaged between the ring element 25 and the cap 24 so as to be secured in place by the cap 24 and the ring element 25. The cover 26 includes an extension 262 for engaging with the switch 31 (FIG. 3) so as to actuate the switch 31 and so as to energize the light bulb 4 when the cover 26 is depressed inward of the cap 24. A spring 242 is provided for biasing the cover 26 outward of the cap 24.

A cylindrical weight device 5 is engaged on the cylindrical body 1 and a sleeve 6 of resilient or spongy material is engaged on the weight device 5, Both the weight device 5 and the sleeve 6 are longer than the cylindrical body 1, best shown in FIG. 3. A wrist strip 51 includes an aperture 511 formed in one end for engaging with the cylindrical body and includes an orifice 512 formed in the other end. A lid 7 includes a tube 70 extended therefrom for engaging with the orifice 512 of the wrist strip 51 and the hole 11 of the cylindrical body 10, and includes a number of hook means 71 formed on the free end of the tube 70 for engaging with the cylindrical body 10 so as to be secured to the cylindrical body 1. The other end of the wrist strip 51 is engaged between the weight device 5 and the lid 7. The lid 7 further includes a screw hole 72 formed therein for engaging with the bolt 23 so as to be further secured to the cylindrical body. Another weight device 9 may include a bolt 73 for threadedly engaging with the screw hole 72 of the lid 7 for lift training purposes.

In operation, the wrist portion of the users may engage through the space formed between the wrist strip 51 and the sleeve 6 such that the warning and defending assembly may be retained on the wrist portion of the users. When it is required to energize the light bulb 4, it is only required to depress the cover 26 inwards of the cap 24 so as to actuate the switch 31. When the cover 26 is depressed to actuate the switch 31 again, the light bulb 4 is switched off.

Figure 4:
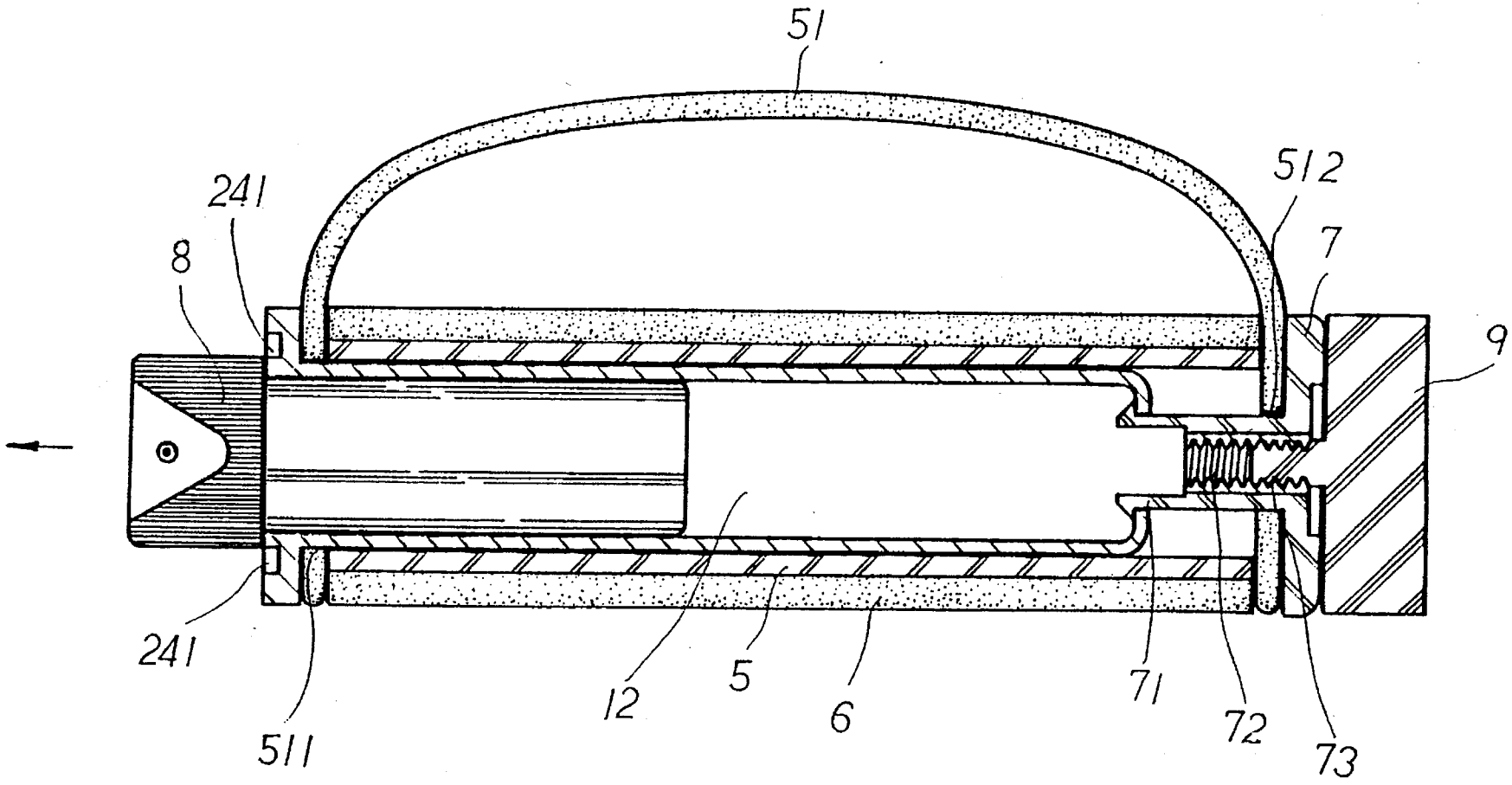
FIGS. 4 and 5 are cross sectional views illustrating two applications of the warning and defending assembly.

Referring next to FIG. 4, when the warning and signaling device 2 is removed from the cylindrical body 1, a gas sprayer 8 is engaged in the cylindrical body 1 for spraying gas and for defending the users from robberies.

Figure 5:
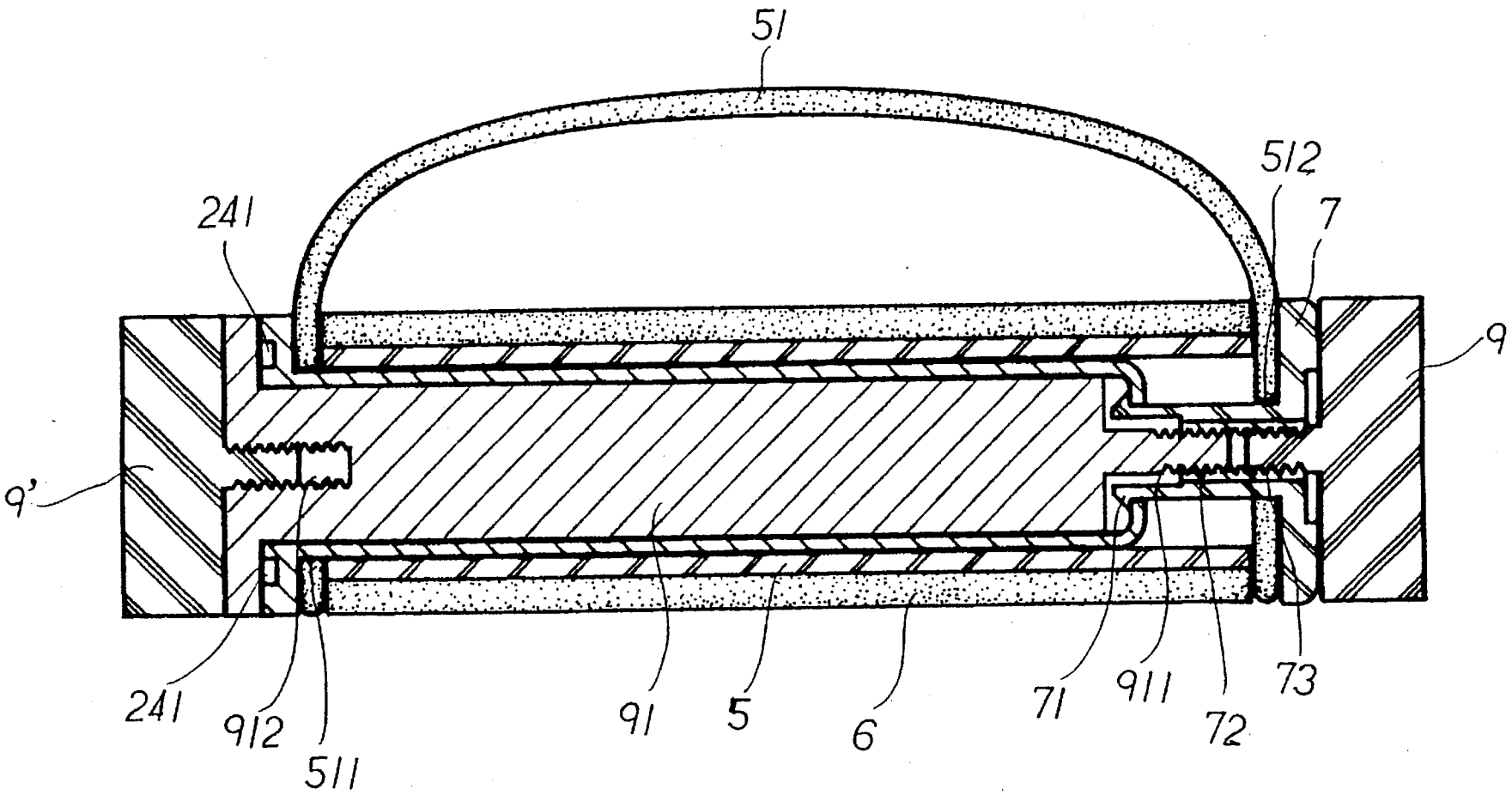

Referring next to FIG. 5, alternatively, a rod 91 may be engaged in the cylindrical body 1 when the warning and signaling device 2 is removed from the cylindrical body 1. The rod 91 includes a bolt 911 formed on one end for engaging with the screw hole 72 of the lid 7 and includes a screw hole 912 formed in the other end for engaging with another weight device 9' in order to increase the weight of the assembly such that the assembly may also be used as a lift training device.

Accordingly, the warning and defending assembly in accordance with the present invention includes a light bulb that may be energized when required, in order to generate a warning signal so as to prevent the users from hurting by vehicles. The gas sprayer may be used to defend the users from robberies. The rod 91 and the weight devices 9, 9' may be provided for lift training purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An illuminating exercise assembly, comprising:

a cylindrical body including a hollow interior, a first end and a second end;

a lid engaged on said first end of said cylindrical body having a screw hole formed therein;

a housing engaged in said cylindrical body having a first end and a second end, said first end having a bolt extended therefrom for engaging with said screw hole of said lid; and a light-generating means engaged in said second end of said housing for generating light so as to provide a warning signal, wherein said light-generating means includes a circuit board and a light bulb received in said second end of said housing, a switch secured to said circuit board, a cap secured to said second end of said housing, a cover slidably engaged in said cap, means for biasing said cover outward of said cap, means for retaining said cover in said cap and for limiting outward movement of said cover, and an extension extending from said cover for engaging said switch so as to actuate said switch when said cover is depressed inward of said cap.

2. An illuminating exercise assembly, comprising:

a cylindrical body having a hollow interior, a first end and a second end;

a lid engaged on the first end of the cylindrical body having a screw hole formed therein; and a device including a first end and a second end, wherein the first end of the device is engaged with the cylindrical body and includes a bolt extended therefrom for engaging with the screw hole of the lid, wherein the device includes a housing having a light-generating means for providing a warning signal.

3. An assembly according to claim 2, wherein the light generating means includes a circuit board, and the light generating means includes a light bulb received at one end of the housing.

4. An assembly according to claim 3, wherein a switch is operatively connected to the circuit board.

5. An assembly according to claim 4, wherein a cap is secured to the one end of the housing which receives the light bulb, a cover is slidably engaged in the cap, a means for biasing is provided to bias the cover outward from the cap, a means for retaining is provided for retaining the cover in the cap and for limiting outward movement of the cover, wherein the cover includes an extension for engaging with the switch so as to actuate the switch when the cover is depressed inward with respect to the cap.

6. An illuminating exercise assembly, comprising:

a cylindrical body having a hollow interior, a first end and a second end;

a lid engaged on said first end of said cylindrical body having a screw hole formed therein; and a device including a first end and a second end, wherein the first end of the device is engaged with the cylindrical body and includes a bolt extended therefrom for engaging with the screw hole of the lid, wherein the device includes an elongated housing for holding batteries, wherein the batteries are electrically connectable to a light bulb, and wherein a cover is provided to enclose the light bulb within a cap provided on the housing.

* * * * *